US008449304B1

(12) United States Patent
Lin et al.

(10) Patent No.: US 8,449,304 B1
(45) Date of Patent: May 28, 2013

(54) ELECTRIC CONNECTOR ADAPTED FOR CONNECTING WITH A MATED CONNECTOR BY VIRTUE OF MAGNETIC ATTRACTION

(75) Inventors: Jui-Pin Lin, New Taipei (TW); Ming-Chun Lai, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/325,380

(22) Filed: Dec. 14, 2011

(51) Int. Cl.
*H01R 11/30* (2006.01)

(52) U.S. Cl.
USPC ..... 439/39; 439/700

(58) Field of Classification Search
USPC ..... 439/39, 482, 607.01, 607.34, 607.58, 439/700, 816, 824
See application file for complete search history.

(56) References Cited

U.S. PATENT DOCUMENTS

| | | | | |
|---|---|---|---|---|
| 6,210,232 | B1 * | 4/2001 | Lai et al. | 439/620.08 |
| 6,957,982 | B1 * | 10/2005 | Hyland et al. | 439/620.05 |
| 7,008,762 | B2 * | 3/2006 | Zhang et al. | 439/541.5 |
| 7,083,468 | B2 * | 8/2006 | Walker et al. | 439/541.5 |
| 8,052,470 | B1 * | 11/2011 | Lin | 439/607.01 |
| 8,083,548 | B1 * | 12/2011 | Lin | 439/607.34 |
| 8,182,288 | B1 * | 5/2012 | Lin | 439/607.01 |
| 8,241,043 | B1 * | 8/2012 | Lin | 439/39 |

* cited by examiner

*Primary Examiner* — Thanh Tam Le
(74) *Attorney, Agent, or Firm* — WPAT, P.C.; Anthony King

(57) ABSTRACT

An electric connector includes an insulating housing having a base board, two side boards, a top board and a bottom board which define a receiving space thereamong. A terminal body protrudes rearward from a rear surface of the base board in the receiving space. A plurality of probe terminals is assembled in the insulating housing. A magnet unit includes a plurality of magnets stood together to show a shape matched with the receiving space of the insulating housing for being assembled in the receiving space. A metal shell is mounted to the insulating housing to enclose the insulating housing and the magnet unit. The metal shell further electrically resists against rear sides of the magnets to secure the magnet unit in the insulating housing.

8 Claims, 4 Drawing Sheets

ELECTRIC CONNECTOR ADAPTED FOR CONNECTING WITH A MATED CONNECTOR BY VIRTUE OF MAGNETIC ATTRACTION

BACKGROUND OF THE INVENTION

1. Field of the Invention

The present invention relates to an electric connector, and more particularly to an electric connector adapted for connecting with a mated connector by virtue of magnetic attraction.

2. The Related Art

A traditional electric connector connected with a mated connector by magnetic attraction generally includes an insulating housing defining a receiving space therein, a plurality of terminals assembled in the insulating housing respectively, and a magnet unit positioned in the receiving space. Each of the terminals has a touching portion stretching into the receiving space so that takes up a part of the receiving space. So, the magnet unit has no option but to be assembled in the remained part of the receiving space. As a result, the size of the magnet unit is far less than the receiving space and the magnet unit provides a relatively weak magnetic attraction force when the electric connector is connected with a mated connector, so that often results in an unsteady connection between the foregoing electric connector and the mated connector.

SUMMARY OF THE INVENTION

An object of the present invention is to provide an electric connector. The electric connector includes an insulating housing, a plurality of probe terminals, a magnet unit and a metal shell. The insulating housing has a base board. Top and bottom edges of the base board extend rearward to form a top board and a bottom board. Two side boards extend rearward from two ends of a rear surface of the base board. The rear surface of the base board further protrudes rearward to form a terminal body. A receiving space is formed among the base board, the side boards, the top board and the bottom board with the terminal body located in the receiving space. The insulating housing defines a plurality of inserting holes each penetrating through the base board and the terminal body along a front-to-rear direction. The probe terminals are inserted forward in the inserting holes of the insulating housing respectively. The magnet unit includes a plurality of magnets stood together to show a shape matched with the receiving space of the insulating housing for being assembled in the receiving space. The metal shell is mounted to the insulating housing to enclose the insulating housing and the magnet unit. The metal shell further electrically resists against rear sides of the magnets to secure the magnet unit in the insulating housing.

As described above, the probe terminals are inserted in the inserting holes of the insulating housing, and the magnet unit is assembled in the receiving space of the insulating housing, so as to effectively make use of the inner space of the electric connector. So, it is in favor of enlarging the size of the magnet unit so as to reinforce the magnetic attraction between the electric connector and a mated connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
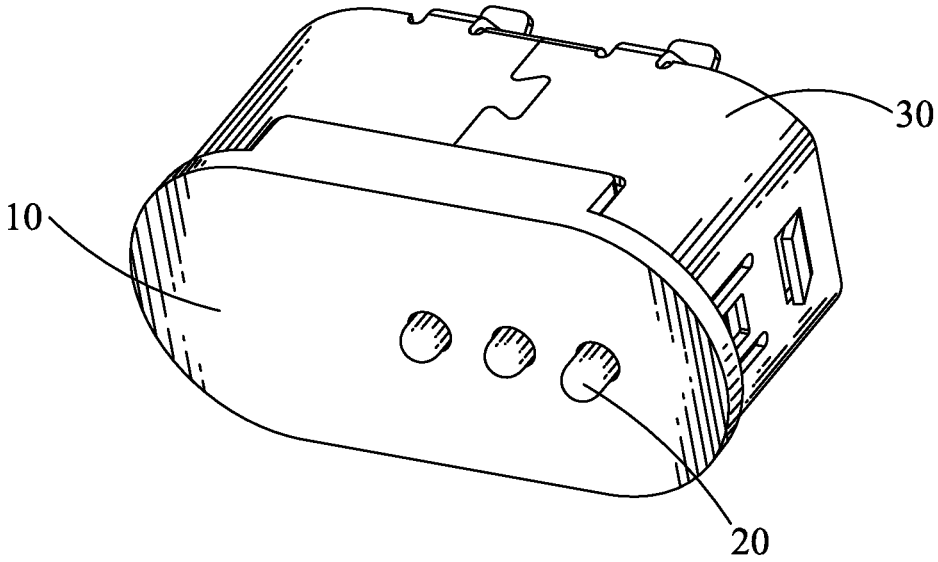
FIG. 1 is an assembled perspective view of an electric connector in accordance with an embodiment of the present invention.
Figure 2:
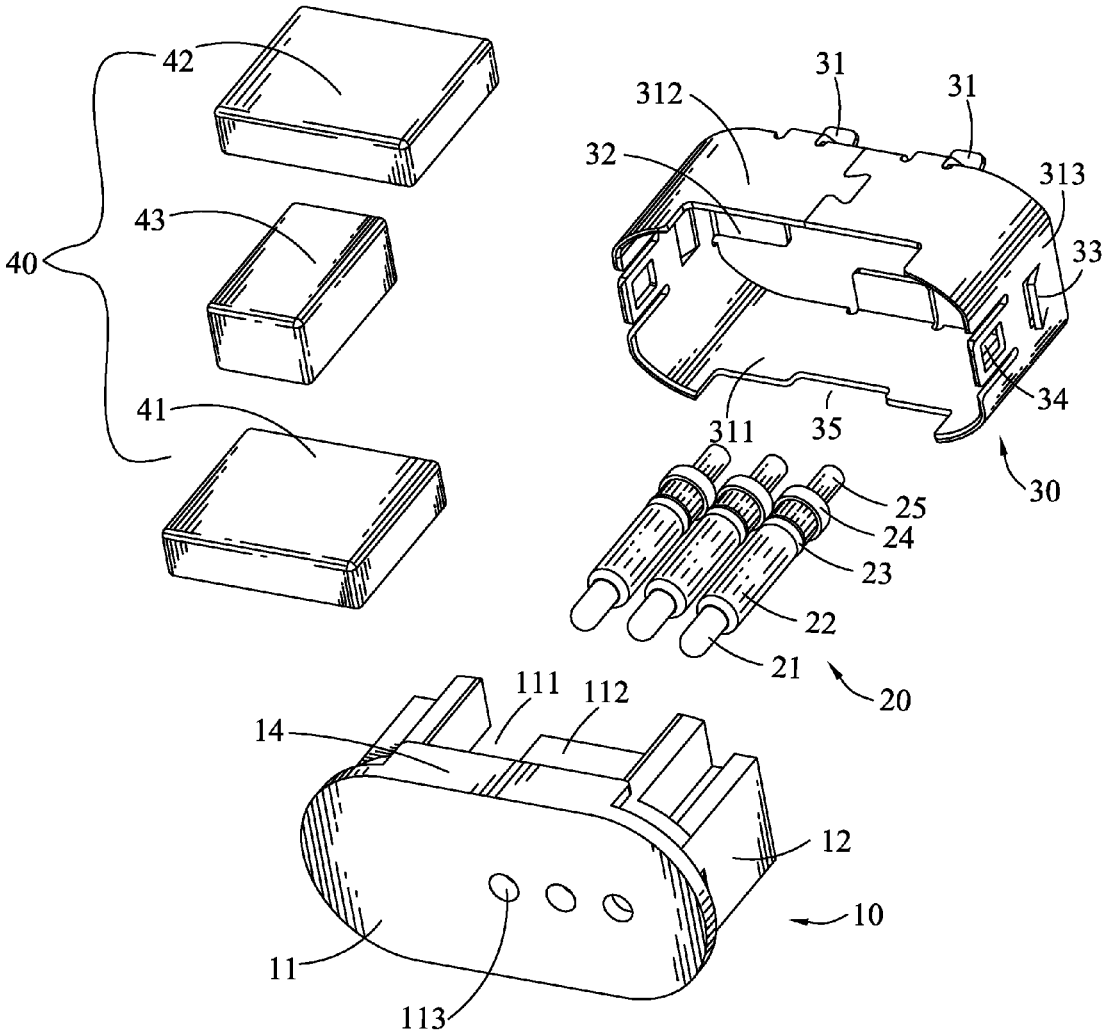
FIG. 2 and FIG. 3 are exploded perspective views of the electric connector shown in FIG. 1.

Referring to FIGS. 1-2, an electric connector according to an embodiment of the present invention includes an insulating housing 10, a plurality of probe terminals 20 assembled in the insulating housing 10, a metal shell 30 enclosing the insulating housing 10, and a magnet unit 40 assembled between the insulating housing 10 and the metal shell 30.

Figure 3:
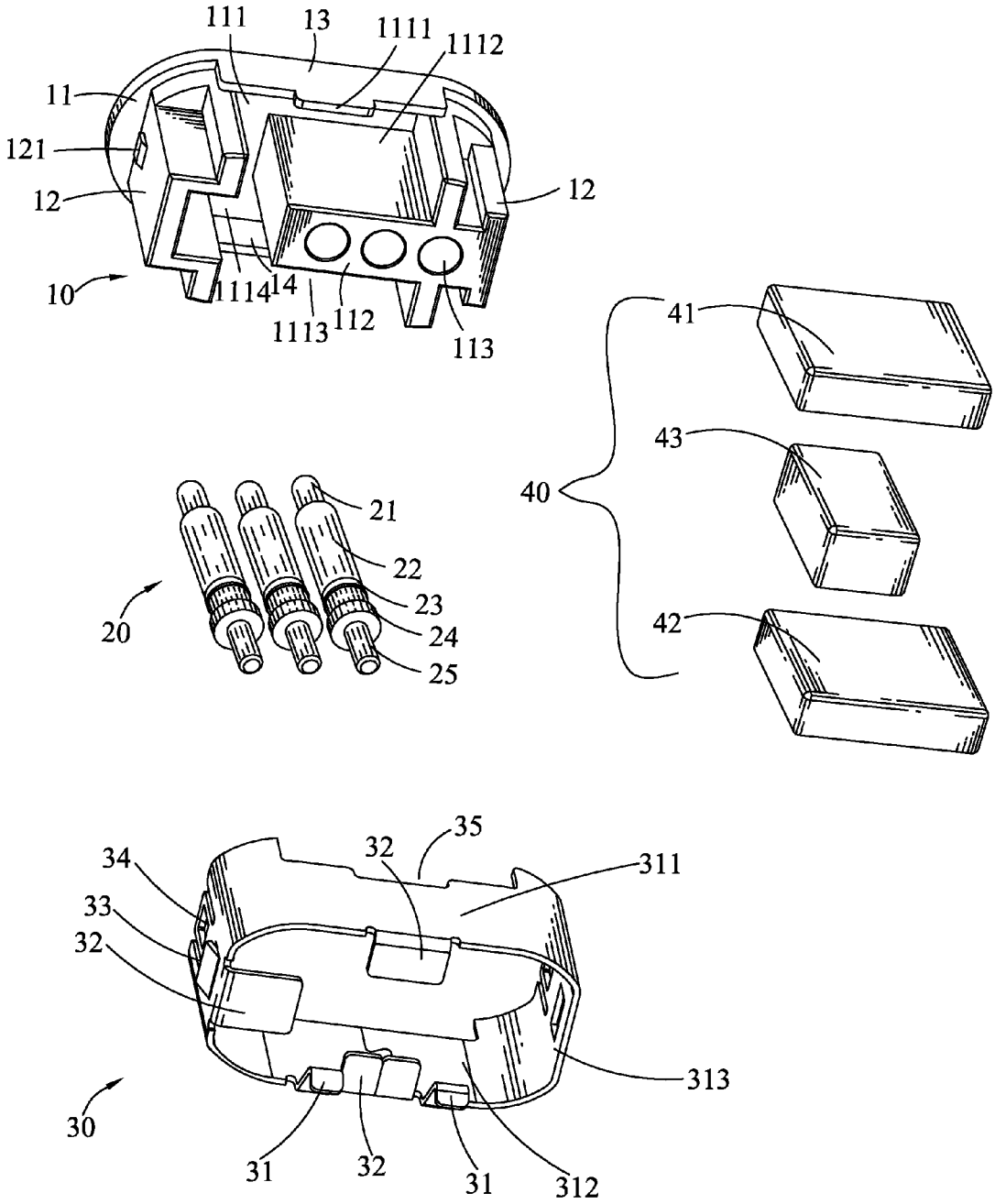
Figure 4:
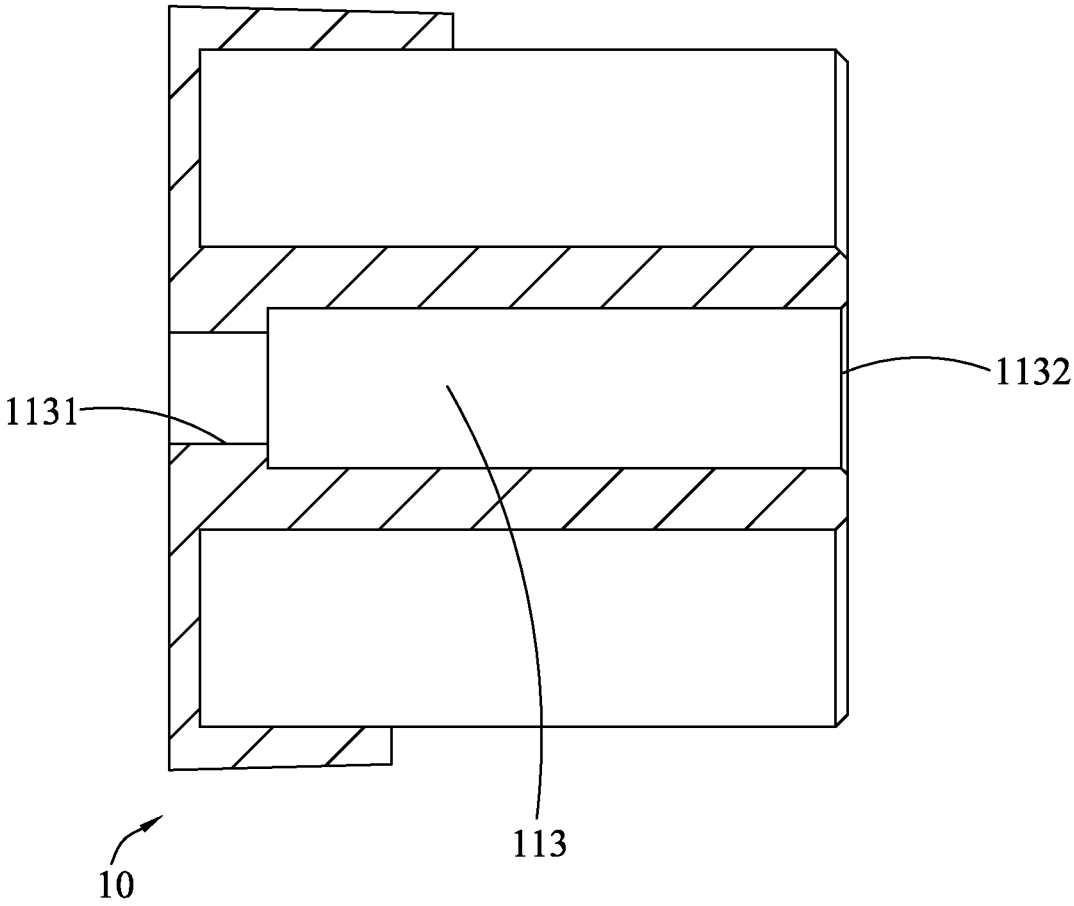
FIG. 4 is a cross-sectional view of an insulating housing of the electric connector shown in FIG. 1.

Referring to FIG. 2, FIG. 3 and FIG. 4, the insulating housing 10 has a base board 11 and two side boards 12 extending rearward from two ends of a rear surface of the base board 11. Top and bottom edges of the base board 11 extend rearward to form a top board 13 and a bottom board 14. The top board 13 and the bottom board 14 each have a shorter length than the side board 12. A middle of a rear edge of the top board 13 protrudes rearward to form a foolproof slice 1111. The rear surface of the base board 11 further protrudes rearward to form a terminal body 112 which is integrated with a substantial middle of an inside face of one side board 12 and spaced from the top board 13, the bottom board 14 and the other side board 12. A receiving space 111 is formed among the base board 11, the side boards 12, the top board 13 and the bottom board 14 with the terminal body 112 located in the receiving space 111. The insulating housing 10 defines a plurality of inserting holes 113 each penetrating through the base board 11 and the terminal body 112 along a front-to-rear direction. An inner sidewall of the inserting hole 113 has a front portion thereof protruded inward to form a ring-shaped blocking wall 1131, and has a rear portion thereof concaved inward to form a circular blocking groove 1132. The receiving space 111 includes an upper space 1112 between the top board 13 and the terminal body 112, a lower space 1113 between the bottom board 14 and the terminal body 112, and a mid-space 1114 between the other side board 12 and the terminal body 112 and connecting with two corresponding ends of the upper space 1112 and the lower space 1113. An outside surface of each side board 12 defines a block 121.

Referring to FIGS. 2-3, each of the probe terminals 20 includes a plunger 21 and a barrel 22 which is made of metal material and has a rear end thereof sealed up and a front end thereof opened freely. The plunger 21 is retractably restrained in the barrel 22 by means of an elastic element (not shown) elastically positioned between the plunger 21 and the barrel 22, with a front end thereof stretching outside from the opened front end of the barrel 22. A periphery outside of the barrel 22 protrudes outward to form a ring-shaped blocking portion 24 at a rear end thereof. The periphery outside of the barrel 22 further protrudes outward to form a fastening portion 23 apart from the blocking portion 24 and having a smaller outer diameter than that of the blocking portion 24. The rear end of the barrel 22 extends rearward to form a soldering portion 25.

Referring to FIGS. 2-3, the metal shell 30 is curved from a metal plate and has a top plate 311, two side plates 313 and two bottom plates 312 wedged with each other. A plurality of blocking slices 32 perpendicularly bends inward from rear edges of the top plate 311, the bottom plates 312 and one side plate 313. The top plate 311 of the metal shell 30 defines a foolproof gap 35 at a front edge thereof for restraining the foolproof slice 1111 of the insulating housing 10 therein. A pair of buckle holes 34 is opened in the side plates 313 of the metal shell 30 respectively. Rear edges of the bottom plates 312 of the metal shell 30 extend rearward to form a plurality of contacting slices 31 inclining upward in the process of extending rearward with distal ends thereof bending downward.

Referring to FIGS. 2-3, the magnet unit 40 includes a mid-magnet 43, an upper magnet 41 and a lower magnet 42 of which both have the same magnetism opposite to that of the mid-magnet 43. The upper magnet 41, the lower magnet 42 and the mid-magnet 43 are stood together to show a shape matched with the receiving space 111 of the insulating housing 10 for being assembled in the receiving space 111.

Referring to FIGS. 1-4, when assembling the electric connector, the probe terminal 20 is inserted forward in the inserting hole 113 of the insulating housing 10, wherein the front end of the barrel 22 resists against a rear of the blocking wall 1131 and the blocking portion 24 is positioned in the blocking groove 1132. The plunger 21 retractably stretches forward out of the inserting hole 113 and beyond a front side of the base board 11. The soldering portions 25 project behind the terminal body 112 for being soldered with an external printed circuit board (not shown). The fastening portion 23 abuts against an inner side of the inserting hole 113 to secure the barrel 22 in the inserting hole 113. The magnet unit 40 is assembled in the receiving space 111 of the insulating housing 10. In detail, the upper magnet 41 is disposed in the upper space 1112, the lower magnet 42 is disposed in the lower space 1113 and the mid-magnet 43 is disposed in the mid-space 1114, to make the polarities of the upper magnet 41, the mid-magnet 43 and the lower magnet 42 staggered in case of repelling one another. The metal shell 30 is mounted to the insulating housing 10 to enclose the insulating housing 10 and the magnetic unit 40 by restraining the foolproof slice 1111 in the foolproof gap 35 and buckling the blocks 121 in the buckle holes 34, respectively. The blocking slices 32 of the metal shell 30 electrically resist against rear sides of the upper magnet 41, the mid-magnet 43 and the lower magnet 42 to secure the magnet unit 40 in the insulating housing 10. The contacting slices 31 freely stretch behind the magnet unit 40.

As described above, the probe terminals 20 are inserted in the inserting holes 113 of the insulating housing 10, and the magnet unit 40 is assembled in the receiving space 111 of the insulating housing 10, so as to effectively make use of the inner space of the electric connector. So, it is in favor of enlarging the size of the magnet unit 40 so as to reinforce the magnetic attraction between the electric connector and a mated connector (not shown).

What is claimed is:

1. An electric connector, comprising:

an insulating housing having a base board, top and bottom edges of the base board extending rearward to form a top board and a bottom board, two side boards extending rearward from two ends of a rear surface of the base board, the rear surface of the base board further protruding rearward to form a terminal body, a receiving space being formed among the base board, the side boards, the top board and the bottom board, the terminal body located in the receiving space, the insulating housing defining a plurality of inserting holes each penetrating through the base board and the terminal body along a front-to-rear direction;

a plurality of probe terminals inserted forward in the inserting holes of the insulating housing respectively;

a magnet unit including a plurality of magnets stood together to show a shape matched with the receiving space of the insulating housing for being assembled in the receiving space; and a metal shell mounted to the insulating housing to enclose the insulating housing and the magnet unit, the metal shell further electrically resisting against rear sides of the magnets to secure the magnet unit in the insulating housing.

2. The electric connector as claimed in claim 1, wherein the magnet unit includes a mid-magnet, an upper magnet and a lower magnet of which both have the same magnetism opposite to that of the mid-magnet, the terminal body of the insulating housing is integrated with a substantial middle of an inside face of one side board and spaced from the top board, the bottom board and the other side board, the receiving space includes an upper space between the top board and the terminal body for receiving the upper magnet therein, a lower space between the bottom board and the terminal body for receiving the lower magnet therein, and a mid-space between the other side board and the terminal body and connecting with two corresponding ends of the upper space and the lower space for receiving the mid-magnet therein.

3. The electric connector as claimed in claim 1, wherein the metal shell is curved from a metal plate and has a top plate, two side plates and two bottom plates wedged with each other, a plurality of blocking slices is perpendicularly bent inward from rear edges of the top plate, the bottom plates and one side plate to electrically resist against the rear sides of the magnets.

4. The electric connector as claimed in claim 3, wherein the top board and the bottom board each has a shorter length than the side board, a middle of a rear edge of the top board protrudes rearward to form a foolproof slice, the top plate of the metal shell defines a foolproof gap at a front edge thereof for restraining the foolproof slice therein.

5. The electric connector as claimed in claim 3, wherein a pair of buckle holes is opened in the side plates of the metal shell respectively, an outside surface of each side board of the insulating housing defines a block buckled in the corresponding buckle hole of the metal shell.

6. The electric connector as claimed in claim 3, wherein rear edges of the bottom plates of the metal shell extend rearward to form a plurality of contacting slices inclining upward in the process of extending rearward, with distal ends thereof bending downward, the contacting slices freely stretch behind the magnet unit.

7. The electric connector as claimed in claim 1, wherein an inner sidewall of the inserting hole has a front portion thereof protruded inward to form a ring-shaped blocking wall, and has a rear portion thereof concaved inward to form a circular blocking groove, each of the probe terminals includes a plunger, and a barrel made of metal material and having a front end thereof opened freely, the plunger is retractably restrained in the barrel with a front end thereof stretching outside from the opened front end of the barrel, a periphery outside of the barrel protrudes outward to form a ring-shaped blocking portion at a rear end thereof, the rear end of the barrel extends rearward to form a soldering portion, the probe terminal is inserted forward in the inserting hole of the insulating housing with the front end of the barrel resisting against a rear of the blocking wall and the blocking portion being positioned in the blocking groove, the plunger retractably stretches forward out of the inserting hole and beyond a front side of the base board, and the soldering portions project behind the terminal body.

8. The electric connector as claimed in claim 7, wherein the periphery outside of the barrel further protrudes outward to form a fastening portion apart from the blocking portion and having a smaller outer diameter than that of the blocking portion, the fastening portion abuts against an inner side of the inserting hole to secure the barrel in the inserting hole.

* * * * *